US007043179B2

(12) United States Patent
Matsumoto et al.

(10) Patent No.: US 7,043,179 B2
(45) Date of Patent: May 9, 2006

(54) TONER REPLENISHING DEVICE WITH TIMING CONTROL OF TONER REPLENISHING DEVICE

(75) Inventors: Junichi Matsumoto, Kanagawa (JP); Nobuo Iwata, Kanagawa (JP); Satoshi Muramatsu, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 12 days.

(21) Appl. No.: 10/859,186

(22) Filed: Jun. 3, 2004

(65) Prior Publication Data

US 2005/0025527 A1 Feb. 3, 2005

(30) Foreign Application Priority Data

Jun. 27, 2003 (JP) ..... 2003-183776

(51) Int. Cl.
*G03G 15/08* (2006.01)

(52) U.S. Cl. ..... 399/258

(58) Field of Classification Search ..... 399/258
See application file for complete search history.

(56) References Cited

U.S. PATENT DOCUMENTS 4,106,611 A 8/1978 Suzuki et al.
4,126,400 A 11/1978 Suzuki et al.
4,160,200 A 7/1979 Imamura et al.
4,165,190 A 8/1979 Suzuki et al.
4,228,577 A 10/1980 Suzuki et al.
4,335,970 A 6/1982 Iwata et al.
4,411,539 A 10/1983 Iwata et al.
4,416,556 A 11/1983 Iwata et al.
4,436,440 A 3/1984 Iwata
4,572,682 A 2/1986 Iwata
4,747,710 A 5/1988 Iwata et al.
4,908,661 A 3/1990 Iwata et al.
4,983,055 A 1/1991 Iwata
5,008,711 A 4/1991 Sakamoto et al.
5,092,691 A 3/1992 Iwata
5,400,127 A 3/1995 Arai et al.
5,467,175 A 11/1995 Takagaki et al.
5,599,645 A 2/1997 Tamiya et al.
5,638,159 A 6/1997 Kai et al.
5,678,161 A 10/1997 Kurotaka et al.
5,797,074 A 8/1998 Kasahara et al.
5,799,228 A 8/1998 Iwata et al.
5,815,784 A 9/1998 Kasahara et al.
5,828,926 A 10/1998 Iwata et al.
5,875,380 A 2/1999 Iwata et al.
5,953,567 A 9/1999 Muramatsu et al.
5,960,246 A 9/1999 Kasahara et al.
5,962,783 A 10/1999 Iwata et al.
5,963,240 A 10/1999 Shinohara et al.
5,987,298 A 11/1999 Muramatsu et al.
6,112,046 A 8/2000 Suzuki et al.
6,128,459 A 10/2000 Iwata et al.

(Continued)

*Primary Examiner*—Quana Grainger
(74) *Attorney, Agent, or Firm*—Oblon, Spivak, McClelland, Maier & Neustadt, P.C.

(57) ABSTRACT

A toner replenishing device having a stable performance without causing variation of the toner suction pressure, even if the toner characteristics vary in a toner vessel in a volume-reducing type toner carrying device. In the toner replenishing device comprising a flexible toner storing vessel, a sucking means for arrying the toner in the toner storing vessel to a prescribed place by a negative pressure, and a substantially airtight toner carrying passage, the toner storing vessel being reduced in volume by sucking the toner, the sucking means is a single-shaft eccentric screw pump, whose operation time is longer than the time for generating a maximum pressure.

8 Claims, 6 Drawing Sheets

U.S. PATENT DOCUMENTS 6,142,690 A 11/2000 Yoshimura et al.
6,163,669 A 12/2000 Aoki et al.
6,184,910 B1 2/2001 Sasaki et al.
6,201,941 B1 3/2001 Kasahara et al.
6,282,396 B1 8/2001 Iwata et al.
6,295,437 B1 9/2001 Hodoshima et al.
6,381,435 B1 4/2002 Shinohara et al.
6,393,241 B1 5/2002 Matsumoto et al.
6,507,720 B1 1/2003 Kabumoto et al.
6,526,246 B1 2/2003 Iwata et al.
6,542,707 B1 * 4/2003 Muramatsu et al. ..... 399/258
6,567,637 B1 5/2003 Yanagisawa et al.
6,571,076 B1 5/2003 Kasahara et al.
6,597,883 B1 * 7/2003 Muramatsu et al. ..... 399/258
6,608,983 B1 8/2003 Terazawa et al.
6,608,984 B1 8/2003 Matsumoto et al.
6,628,908 B1 9/2003 Matsumoto et al.
6,628,913 B1 9/2003 Matsumoto et al.
6,628,915 B1 9/2003 Muramatsu et al.
6,678,492 B1 1/2004 Terazawa et al.
6,748,190 B1 6/2004 Yanagisawa et al.
6,785,496 B1 8/2004 Iwata et al.

* cited by examiner

TONER REPLENISHING DEVICE WITH TIMING CONTROL OF TONER REPLENISHING DEVICE

BACKGROUND OF THE INVENTION

1. Field of the Invention

The present invention relates to a toner replenishing device of a developing device used for an image forming device of an electro-photographic system, in particular, for a printer, a facsimile device, or a copier using a binary or a mono-component developer.

2. Description of the Background Art

Hard bottles have been conventionally used as storing vessels for dry toner, a carrier, or a mixture of the toner and carrier (hereafter referred to as toner) used for electrophotography in general. As the conventional toner replenishing devices, one in which a toner agitator-cum-discharge device is provided in the vessel, one which moves the toner in the vessel by rotating the vessel by providing a spiral groove on the vessel wall to discharge the toner, or one which has no discharge mechanism and is manually replenished with the toner, are known. In recent years, however, recovery or recyclability of the toner storing vessel is requested by attaching greater importance to the environmental problem.

Therefore, volume-reducible soft vessels made of flexible materials are proposed, as disclosed in the Japanese Patent Laid-Open Publication, for example, No. 2001-324863 or No. 2002-072649. The dry toner for electrophotograpy is, however, considered very difficult to be discharged from the soft vessel, since it has poor fluidity in general, and is liable to coagulate. This is because an agitator or a discharge mechanism is difficult to be added to the soft vessel, or addition of the discharge mechanism prevents volume reduction, or handleability is poor for manual replenishing.

The toner in the flexible vessel may be sucked and discharged by a sucking type powder pump, or a single-shaft eccentric screw pump, and the volume of the toner vessel may be reduced following toner discharge. Since an automatic volume-reduction type toner carrying apparatus carries the toner by a suction pressure (negative pressure) of the powder pump, carrying volume of the toner varies unless the suction pressure is constant, and the volume of the vessel cannot be gradually reduced. With a constant one-operation time of the powder pump, the pressure generated is constant, however, according to the state of the toner, for example, fluctuation of the toner characteristics due to the environment, or due to storing for a long period, a problem of variation of the suction pressure necessary for carrying the toner occurs.

SUMMERY OF THE INVENTION

An object of the present invention is to provide a toner replenishing device having a stable performance without causing variation in the toner suction pressure, even if the toner characteristics vary in the toner vessel of the volume-reduction type toner carrying apparatus.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT(S)

One embodiment of the present invention is explained in details as below, on the basis of the drawings.

Figure 1:
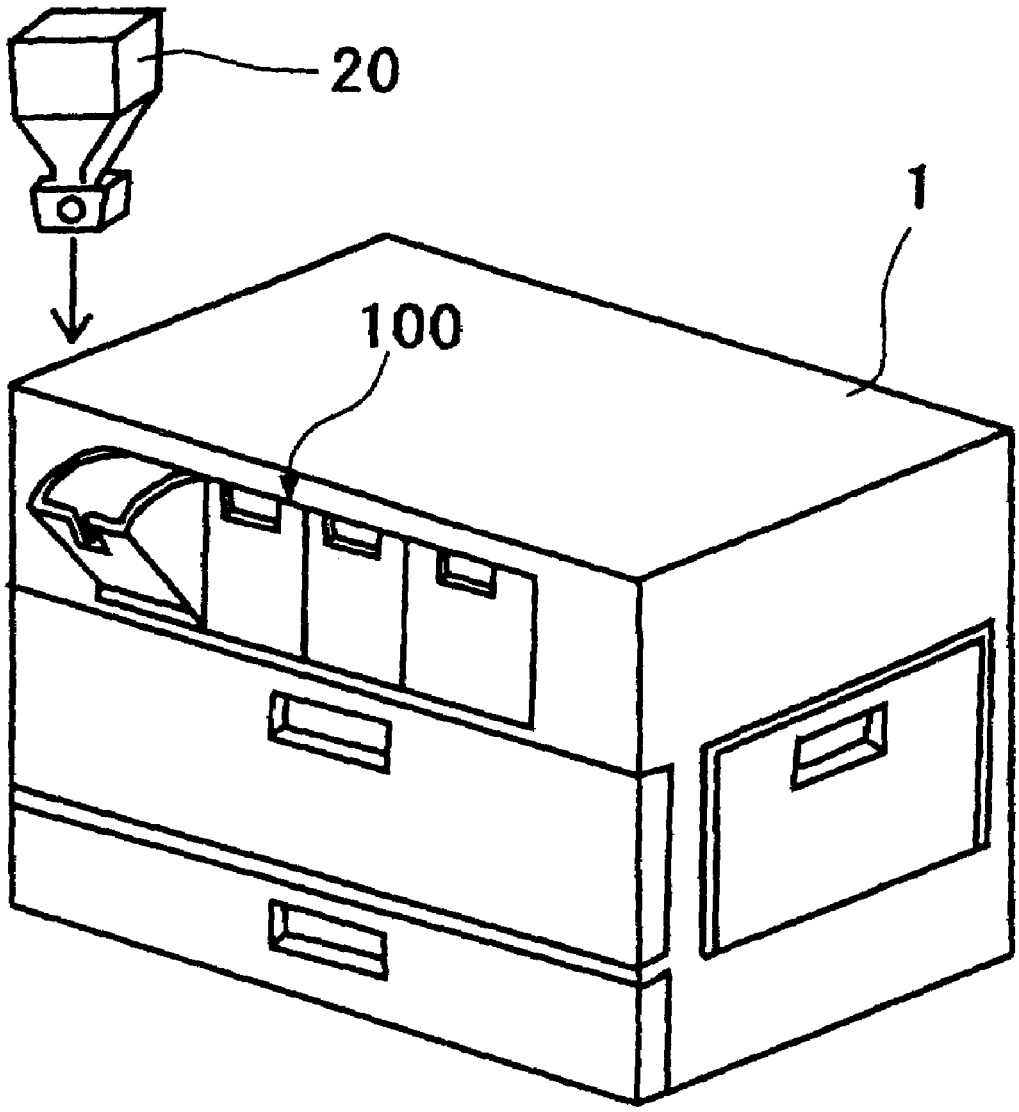
FIG. 1 is a drawing showing a contour of an image forming device which uses the toner replenishing device related to the present invention.

FIG. 1 shows the contour of the image forming device which uses the toner replenishing device related to the present invention. As the toner is consumed according to the forming amount of the images, the toner vessel is replaced when it is empty. The replacement is conducted, as shown in the drawing, by opening a toner vessel attaching/detaching door 100 by drawing it to one side, taking out an empty vessel, setting a new toner storing vessel, and closing the door.

Figure 2:
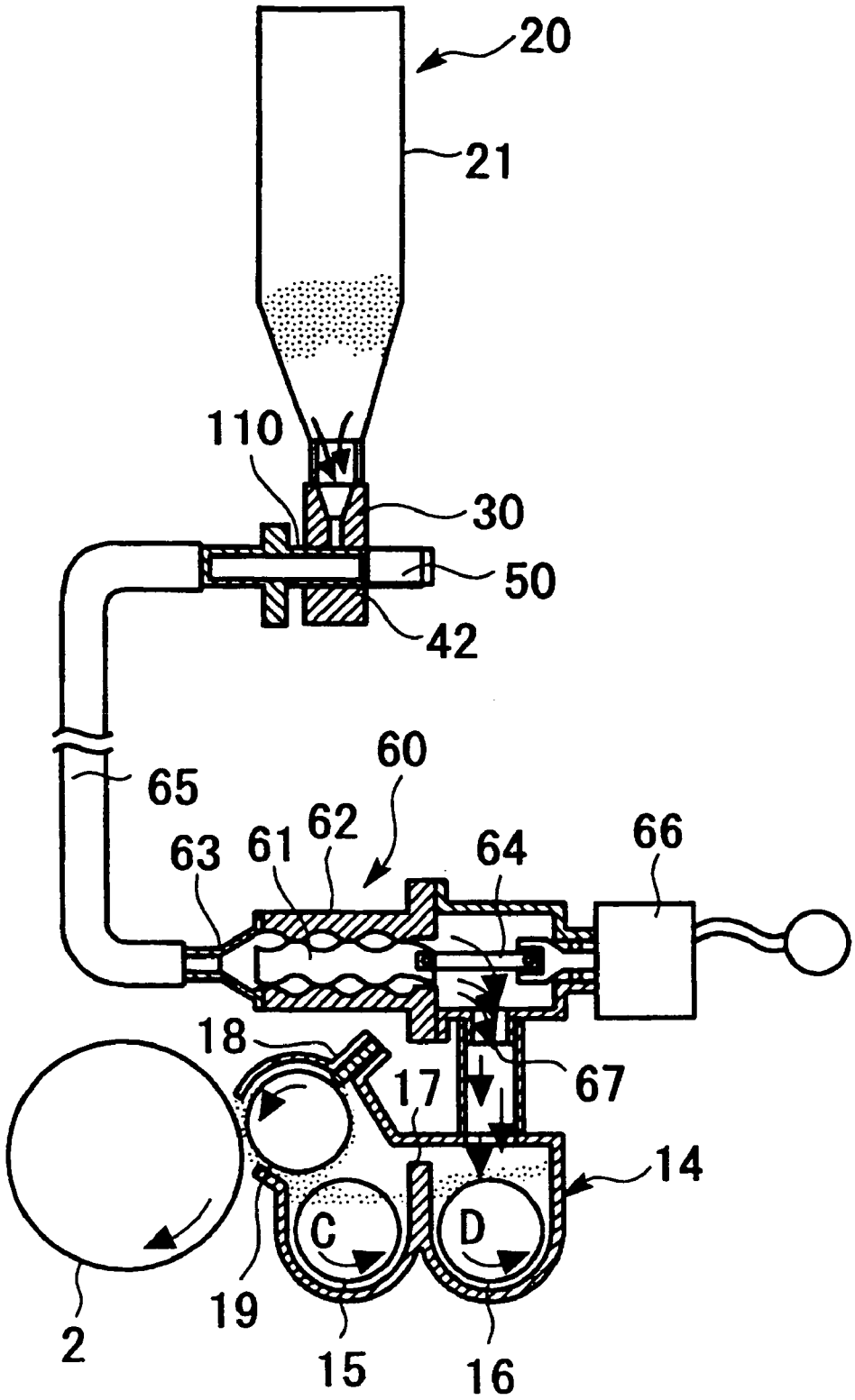
FIG. 2 is a cross-sectional drawing of one part showing a constitution of a toner feeding means to a developing device from the toner vessel.

FIG. 2 shows a constitution of a toner feeding means from the toner vessel to the developing device. As shown in the drawing, an electrostatic latent image is formed on the surface of a photoreceptor drum 2 by a charging device and a photo-writing device (not shown in the figure). A casing 14 composing the developing device contains therein screws 15 and 16 rotating in the arrow directions C, D, having spiral fins called carrying augers, and contains a developer of a mixture of the toner and carrier. In the screw 15, for example, the developer is carried from this side to the deep side in the drawing, and in the screw 16, the developer is carried from the deep side to this side. Parts with no central partition plate 17 are provided in the deep side and this side to form a constitution for agitating the developer while circulating it. A part of the circulating developer is sucked up and attracted to a developing roller 19 by magnetic force, unifomized in thickness by a doctor blade 18, and brought into contact with a photoreceptor, to form a toner image by developing the electrostatic latent image on the photoreceptor by the toner. In this stage, only the toner adheres to the photoreceptor. The development is carried out by replenishing the toner little by little from a toner replenishing port 67, in order to keep a quantity of the toner constant in the circulating developer in the developing device.

A toner replenishing part has the toner storing vessel 20 for storing new toner and the toner in the toner storing vessel 20 is sucked and discharged by the powder pumping means 60 (the single-shaft eccentric screw pump in the present embodiment) to be fed to the toner replenishing port 67 of the developing device.

The toner storing vessel 20 is composed of a bag-like soft vessel 21 for storing the toner and a connector part 30 connected to the lowest part of the toner vessel 21. A suction nozzle 110 is inserted into the connector part. A shutter 50 is provided for stopping flowing out of the toner when the nozzle 110 is not inserted. A sealing material 42 is disposed on both sides of the nozzle 110 or the shutter 50 to keep airtightness.

The powder pumping means 60 is connected to the nozzle 110 via a tube 65. In the present embodiment, the powder pumping means 60 is composed of the single-shaft eccentric screw pump, comprising two main parts of a rotor 61 and a stator 62. The rotor 61 has a spirally twisted circular cross section, and is made of a hard material, while the stator 62 is made of a rubber-like soft material, with an ellipsoidal cross section having a spirally twisted hole. The spiral pitch of the stator 62 is formed in a length of two times of the spiral pitch of the of the rotor 61. By fitting these two parts and rotating the rotor 61, the toner entering the space formed between the rotor 61 and the stator 62 is transferred. A motor 66 drives the rotor 61 via a universal joint 64.

The toner is sucked and carried from the left of the drawing to the right and drops downward from the toner discharging port 67 to be fed to the developing device 14. The part from the nozzle 110 to the developing device 14 is fixed to the main device, and the toner storing vessel 20 is replaced with a new toner storing vessel 20 every time the toner contained therein is used up. The airtightness between the connector part 30 and the nozzle 110 is quite important for preventing contamination or air leakage at detachment and attachment, since the nozzle 110 is detached and attached in every replacement.

Figure 3:
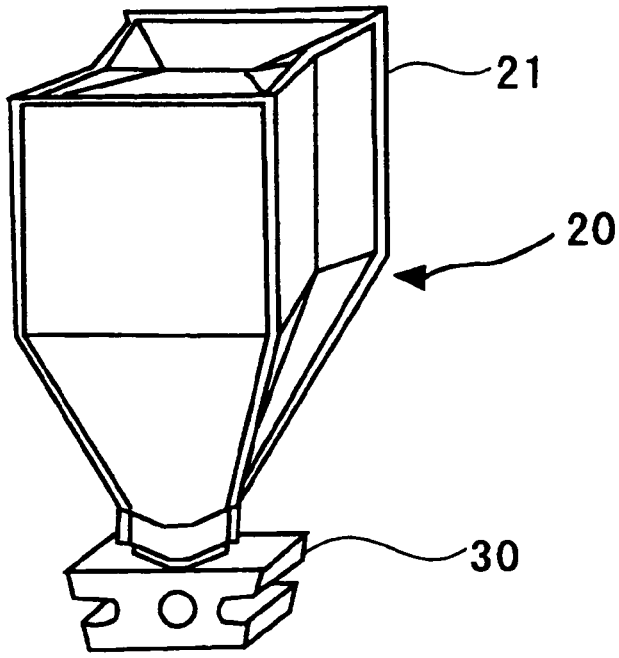
FIG. 3 is a perspective view showing the toner vessel filled with the toner.
Figure 4:
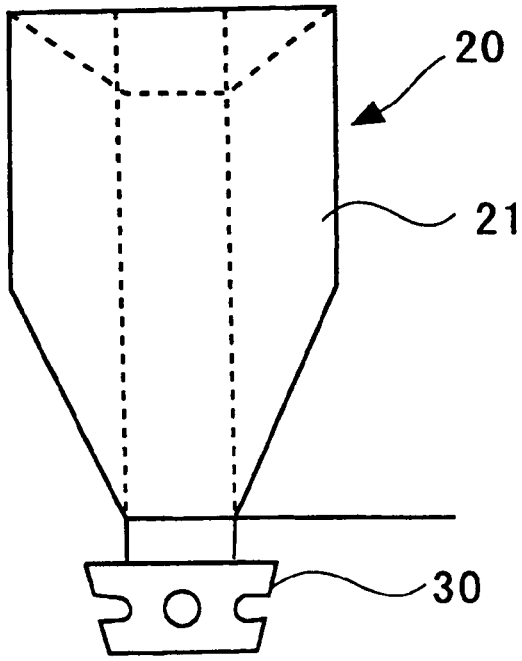
FIG. 4 is a front view showing the toner vessel reduced in volume after discharge of the toner.

FIG. 3 and FIG. 4 show a state of the toner vessel 21 filled with the toner, and a state of the toner vessel 21 volume-reduced or shriveled by discharging the toner in the toner vessel 21, respectively.

A sheet forming the toner vessel 21 is a double-layered sheet with an inner side composed of polyethylene for depositing, and an outer side composed of nylon. Aluminum or PET (polyethylene terephthalate) can be provided on the outer side in order to enhance strength of the sheet. The thickness of the sheet is 50–210 □m.

Figure 5:
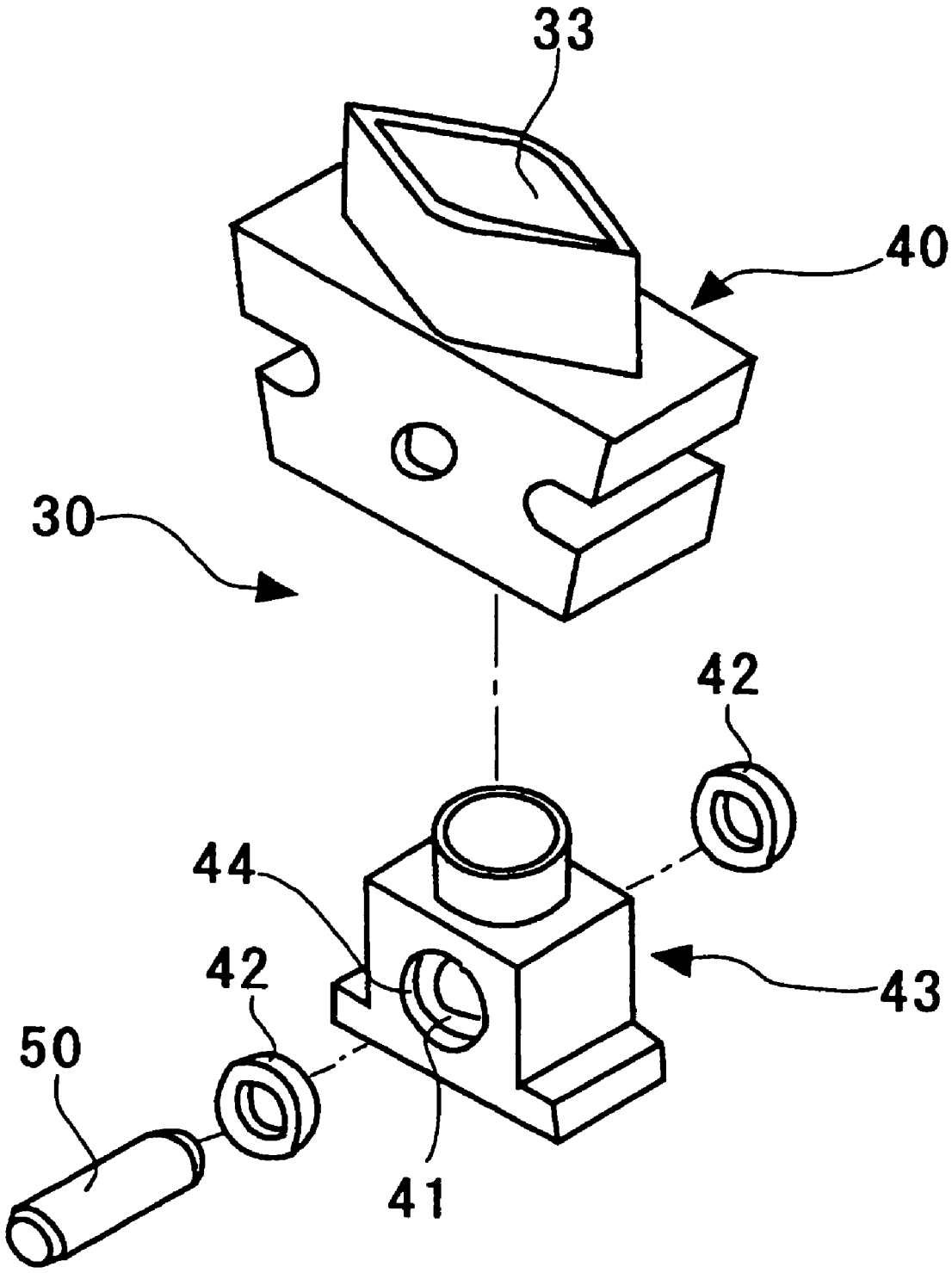
FIG. 5 is an exploded perspective view showing a connector part of the toner vessel.

FIG. 5 shows an exploded view of the connector part 30 of the toner storing vessel 20. The connector part 30 is composed of a connector 40 thermally melt-stuck to the sheet, a cap 43 engaged with the connector 40, the shutter 50, and the sealing material 42 for keeping close contact with the shutter 50. The bottom face of the cap 43 is provided with a circular recessed part 41, to which a filter is stuck to communicate the inside of the vessel with the atmosphere through it.

The characteristics of the connector system are that the shutter 50 does not hinder the passage of the toner as the shutter 50 is extruded to the outside from the connector inside, that the connector 40 can be formed very compact since no retracting space is necessary for retracting the shutter 50 to the outside of the connector 40, and that the shutter 50 is kept stable without being pushed out by the vessel pressure, as the shutter 50 is disposed orthogonal to the passage (or pressure) of the toner.

The connector part 30 is divided into the connector main body 40 and a cap 43 in order to easily fill the toner into the vessel. An integrated constitution narrows the filling path and forms a bent state, while the divided constitution allows straight filling of the toner from a comparatively large opening. The cap is attached after filling the toner, then the shutter 50 is inserted to facilitate filling of the toner. A defect such as contamination of the sealing material by the filling work can be resolved.

The sealing material 42 is formed of a rubber material or the like lightly press-contacting on the shutter 50.

The shutter 50 can be moved by pushing with the finger. In order to prevent the defect of leakage of the toner due to the movement of the shutter 50 during operation, the shutter is preferably sized to 8 mm square at the maximum, desirably 6 mm square or less to avoid accidental pushing with the finger.

When replenishing the toner, the motor is energized by a power source N by a signal indicating the shortage of the toner in the developing device 14, to turn on the single-shaft eccentric screw pump 60, and the toner in the bag-like soft toner vessel 21 is sucked and fed (dropped) to the developer part of the developing device 14. After replenishing a prescribed amount of the toner, the pump 60 is turned off.

Figure 6:
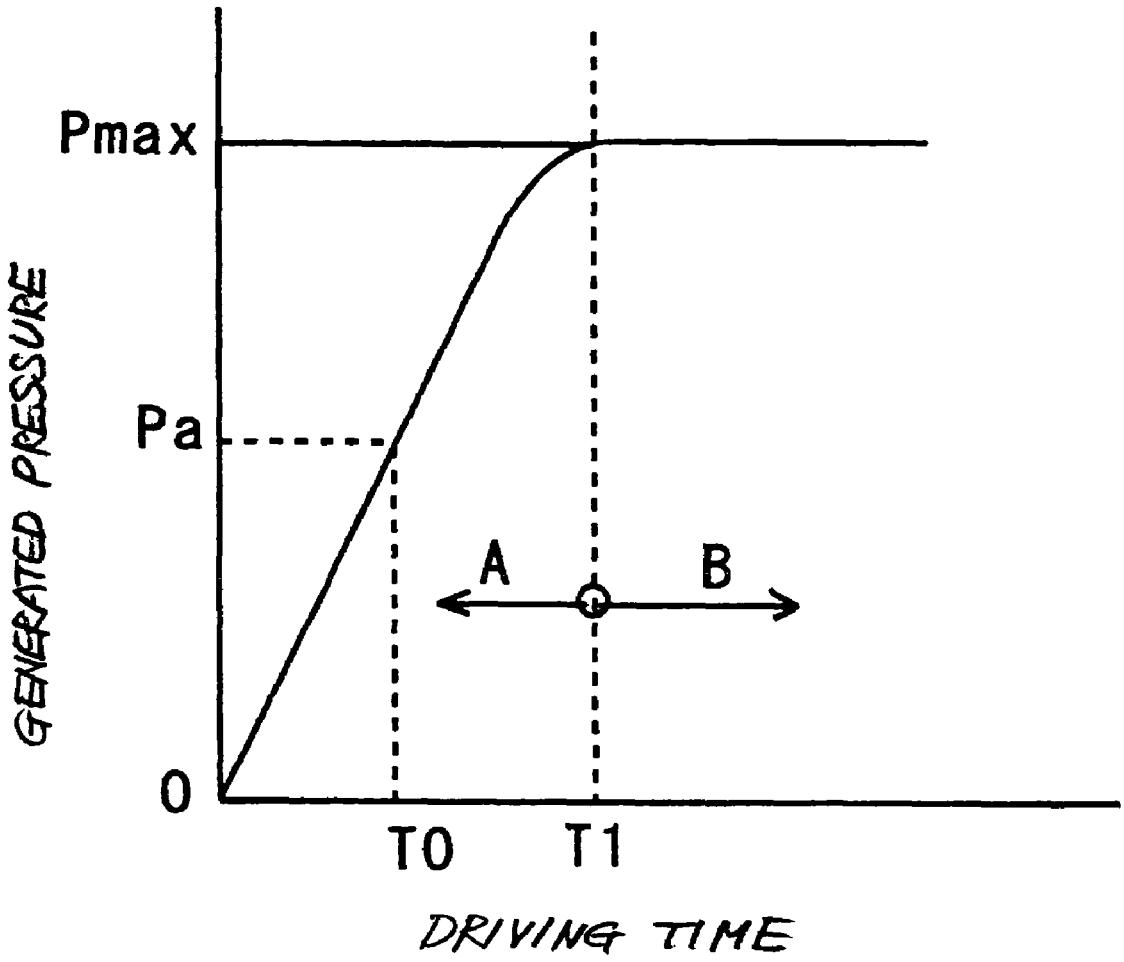
FIG. 6 is a drawing showing a relation of driving time of the single-shaft eccentric screw pump with the suction pressure.

It is supposed that the single-shaft eccentric pump 60 is operated in a driving time in a region A (less than a driving time T1) shown in FIG. 6 in the toner replenishing device of the present embodiment. "A" indicates a case where the pressure of the screw pump 60 has not yet sufficiently risen. A required pressure for sucking the toner at this time is assumed as Pa. The screw pump 60 cannot suck the toner, unless the driving time of the pump 60 is set to T0 or more. The required pressure Pa for sucking the toner is, however, not constant. According to the variation of the toner characteristics due to the surroundings, Pa also varies. In a high temperature and humidity condition, for example, the fluidity of the toner is lowered, and Pa becomes higher than that in a normal temperature. When the toner becomes tight (reduction of air volume included) due to a long-time settling or vibration, Pa becomes high.

FIG. 6 shows a relation between the driving time of the single-shaft eccentric screw pump and the suction pressure. By using the screw pump 60 in a region B (the maximum pressure of the pump) of FIG. 6, therefore, the generated pressure becomes always constant, and the toner can be surely sucked without being affected by the variation of the toner characteristics. The maximum pressure is set to Pa or higher.

The maximum generated pressure can be freely set by the size of the screw pump 60, the rotation speed of the rotor 61, biting amount of the rotor 61 with the stator 62, and is preferably set with a margin of about three times of the required suction pressure of the toner at the normal temperature.

Figure 7:
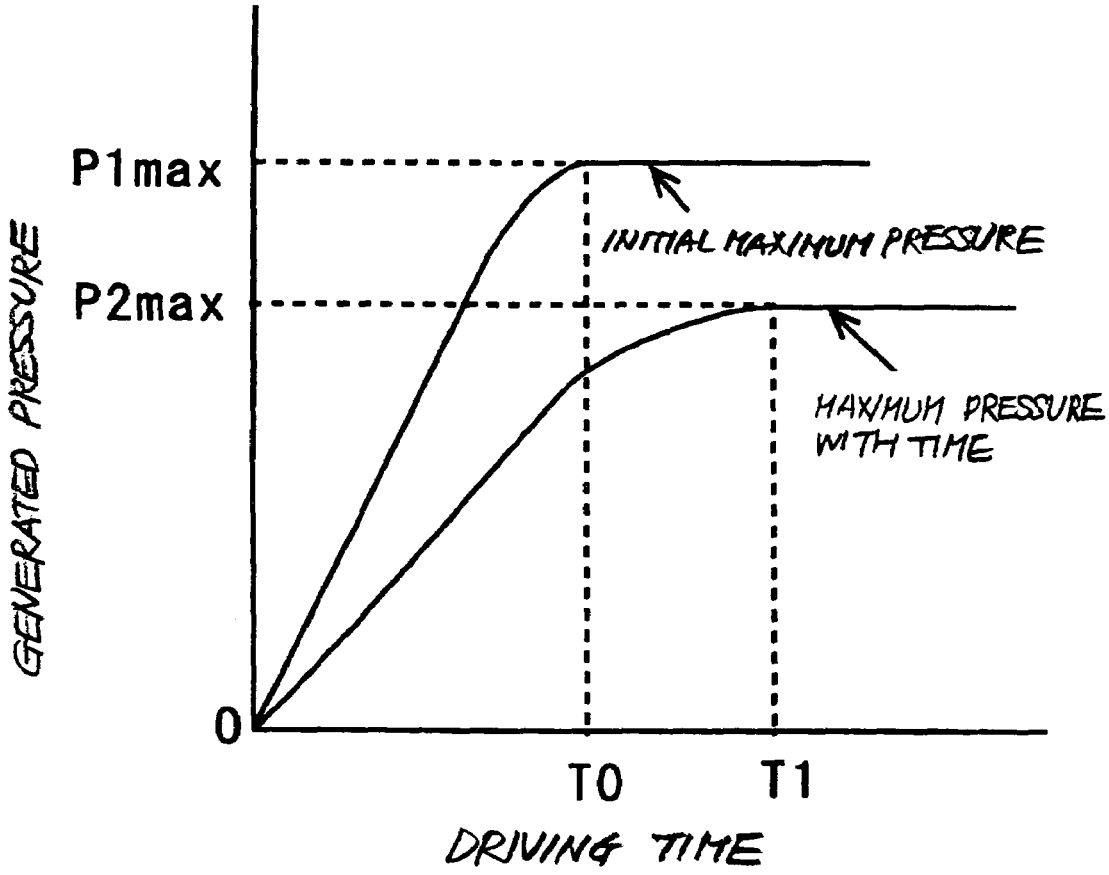
FIG. 7 is a drawing showing a secular change of a relation of driving time of the single-shaft eccentric screw pump with the suction force.

FIG. 7 shows a relation between the driving time of the single-shaft eccentric screw pump 60 and suction pressure based on secular change. The maximum pressure of the screw pump 60 is sometimes lowered due to abrasion of the stator 62 made of a rubber material after a long period of use. As shown in FIG. 7, the time required for saturation becomes longer compared to that in the initial stage, together with the lowering of the maximum pressure. The driving time, therefore, is to be set longer than that for generating the maximum pressure for the single-shaft eccentric pump 60 having a service life equivalent to that of the electrophotographic device main body.

In the automatic volume-reducing type toner carrying device of the present embodiment, securing of airtightness of the replenishing passage including the vessel is important. In order to surely transmit the pressure generated in the single-shaft eccentric screw pump 60 to the toner for carrying, a stable amount of replenishing volume cannot be obtained, unless the airtightness is kept high enough in relation to the pressure generated in the screw pump 60, for preventing sucking air from outside of the replenishing passage (idle sucking). In the case of the maximum pressure of 20 kPa of the screw pump 60, for example, the airtightness of the replenishing passage may be secured higher than that for the pressure. As seen above, even if the condition of the toner varies, a stable amount of replenishing can be secured to surely reduce the volume of the toner vessel 21.

As explained above, the present invention can supply a toner replenishing device having a stable performance without causing variation of the sucking pressure of the toner, even if the toner characteristics vary in the toner vessel of the volume-reducing type toner carrying device.

Various modifications will become possible for those skilled in the art after receiving the teachings of the present disclosure without departing from the scope thereof.

What is claimed is:

1. A toner replenishing device with a flexible toner storing vessel reduced in volume following sucking of the toner, comprising:

sucking means for carrying the toner in the toner storing vessel to a prescribed place by a negative pressure; and a substantially airtight toner carrying passage, wherein the sucking means has a driving time set to be longer than the time for generating the maximum pressure of the sucking means to thereby maintain operation of the sucking means at the maximum pressure of the sucking means.

2. The toner replenishing device as claimed in claim 1, wherein the sucking means comprises a single-shaft eccentric screw pump which sucks and carries the toner by a negative pressure.

3. The toner replenishing device as claimed in claim 2, wherein the operation time of the sucking means is set to be equivalent to the service life of the electrophotographic device, and longer than the time for generating the maximum pressure when the sucking means is used.

4. The toner replenishing device as claimed in claim 2, wherein the maximum pressure of the sucking means is set to be equivalent to the airtightness or below of the replenishing passage including the toner vessel.

5. The toner replenishing device as claimed in claim 1, wherein the maximum pressure of the sucking means is set to be equivalent to the airtightness or below of the replenishing passage including the toner vessel.

6. The toner replenishing device as claimed in claim 1, wherein the operation time of the sucking means is set to be equivalent to the service life of the electrophotographic device, and longer than the time for generating the maximum pressure when the sucking means is used.

7. The toner replenishing device as claimed in claim 6, wherein the maximum pressure of the sucking means is set to be equivalent to the airtightness or below of the replenishing passage including the toner vessel.

8. An image forming apparatus using a toner replenishing device with a flexible toner storing vessel reduced in volume following the suction of the toner, comprising:

sucking means for carrying the toner in the toner storing vessel by a negative pressure to a prescribed place; and a substantially airtight toner carrying passage, wherein the driving time of the sucking means is set to be longer than the time for generating the maximum pressure of the sucking means to thereby maintain operation of the sucking means at the maximum pressure of the sucking means.

* * * * *